US007429959B2

(12) United States Patent
Gerder et al.

(10) Patent No.: US 7,429,959 B2
(45) Date of Patent: Sep. 30, 2008

(54) PROCESS AND DEVICE FOR THE RADIO TRANSMISSION OF SIGNALS GENERATED NEAR THE BODY

(75) Inventors: Henning Gerder, Lübeck (DE); Robert Sliepen, Lübeck (DE); Frank Sattler, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 0 days.

(21) Appl. No.: 11/132,074

(22) Filed: May 18, 2005

(65) Prior Publication Data

US 2006/0022882 A1 Feb. 2, 2006

(30) Foreign Application Priority Data

Jul. 29, 2004 (DE) ..... 10 2004 036 878

(51) Int. Cl.
*H01Q 1/12* (2006.01)

(52) U.S. Cl. ..... 343/718; 343/718; 343/700 MS; 343/876; 343/770

(58) Field of Classification Search ..... 343/718, 343/700 MS, 897, 783, 770, 753, 818, 876
See application file for complete search history.

(56) References Cited

U.S. PATENT DOCUMENTS

| | | | | |
|---|---|---|---|---|
| 4,633,519 | A | 12/1986 | Gotoh et al. | |
| 6,392,610 | B1 | 5/2002 | Braun et al. | |
| 6,433,743 | B1 | 8/2002 | Massey et al. | |
| 6,590,540 | B1 * | 7/2003 | Adams et al. | 343/718 |
| 6,621,457 | B1 * | 9/2003 | Adams et al. | 343/718 |
| 6,972,725 | B1 * | 12/2005 | Adams | 343/718 |
| 2001/0027115 | A1 | 10/2001 | Zilberberg et al. | |
| 2001/0039198 | A1 | 11/2001 | Onishi et al. | |

FOREIGN PATENT DOCUMENTS

| | | | |
|---|---|---|---|
| DE | 196 45 259 | A1 | 5/1998 |
| DE | 102 51 900 | A1 | 5/2004 |
| EP | 1 174 162 | A1 | 1/2002 |
| GB | 2 362 999 | | 12/2001 |
| WO | WO 92/11899 | | 7/1992 |
| WO | WO 00/35124 | | 6/2000 |
| WO | WO 01/31737 | A1 | 5/2001 |
| WO | WO 01/36728 | A1 | 5/2001 |
| WO | WO 01/71940 | A2 | 9/2001 |
| WO | WO 02/05892 | A1 | 1/2002 |

OTHER PUBLICATIONS

Kai Chang; RF and Microwave Wireless Systems; New York: John Wiley & Sons, 2000, p. 67-110; ISBN: 0-471-35199-7.

Andreas F. Molisch and Moe Z. Win; MIMO Systems with Antenna Selection; IEEE Microwave Magazine, Mar. 2004, vol. 5, No. 1, p. 46-56.

Dinesh Rajan and Steven D. Gray; Transmit Diversity Schemes for CDMA-2000; IEEE Wireless Communications and Networking Conference, Sep. 21-24, 1999, vol. 2, pp. 669-673.

* cited by examiner

*Primary Examiner*—Trinh V Dinh
(74) *Attorney, Agent, or Firm*—McGlew & Tuttle, P.C.

(57) ABSTRACT

A process and a device for the radio transmission of signals generated near the body via an array of at least two antennas arranged in different positions near the body. At least one antenna, which will act as the transmitting antenna, is selected before or during the transmission.

6 Claims, 3 Drawing Sheets

PROCESS AND DEVICE FOR THE RADIO TRANSMISSION OF SIGNALS GENERATED NEAR THE BODY

CROSS REFERENCE TO RELATED APPLICATIONS

This application claims the benefit of priority under 35 U.S.C. § 119 of German Application DE 10 2004 036 878.3 filed Jul. 29, 2004, the entire contents of which are incorporated herein by reference.

FIELD OF THE INVENTION

The present invention pertains to a process and a device for the radio transmission of signals generated near the body via an array of at least two antennas arranged in different positions near the body.

BACKGROUND OF THE INVENTION

Use is conceivable wherever users of personal transmitter units must send under varying environmental conditions. Examples are found above all in case of the use of transmitter units arranged near the body when the user of these transmitter units is moving and reliable radio transmission is necessary.

Decisive advantages of wireless systems for data transmission compared to wired systems are applicability in a short time and low effort for installation, area-covering availability and, frequently, advantages in terms of handling. In case of installation near the body, in particular, there are hardly any limitations of the freedom of movement.

A further increase in the use of wireless radio transmission systems can be expected in the course of technical improvements. Hazard potentials or harmful effects that may occur or are linked with such a development are to be identified and eliminated with certainty.

The increasing saturation of the human environment with alternating electromagnetic fields is a circumstance that is invariably brought into connection with the possibility of sporadic harmful effects. In particular, digital signals rich in harmonics and high-frequency fields are sometimes at least assumed to have harmful effects on health or well-being, These harmful effects, which are taken into account, can be partially explained physically especially in connection with polar liquids; they are usually not detectable at relevant field intensities, but also cannot be read without certainty. However, the responsible management of technical infrastructure also requires that hypothetical harmful effects on health be also ruled out as much as possible.

The hazard potential is to be kept as low as possible in justified cases, in which such a hypothetical harmful effect must be accepted. Moreover, it is also useful to minimize the radiation exposure caused by alternating electromagnetic fields in order to further improve the acceptance of wireless systems, which could open up the utilization of undoubtedly existing advantages of such systems in additional fields of application.

Such a field of application is the use of physical sensors directly at the human body. Wired connection has decisive drawbacks here in terms of handling compared to the wireless connection. In case of the application of various sensors, in particular, the handling of these sensors should, however, be as simple as possible, and the user's free space of movement should be restricted as little as possible.

An especially sensitive subject is the generation of high-frequency electromagnetic fields directly near the body, which is certainly due at least partly to the wide popularization of high-frequency mobile telephones. The area near the body is to be defined in this connection as the area that is characterized by distances from the body surface that are similar to or shorter than the dimensions of the human body.

On the one hand, the use of transmitters for radio transmission requires certain minimum levels in order to guarantee reception; on the other hand, precisely the acceptance of arrangement near the body does offer decisive advantages concerning comfort, availability and possibilities of application of wireless transmission systems. Signals to be transmitted are frequently generated near the body. If they are transmitted at a location close to the site at which they are generated, this means a reduction of the effort, because the installation of means for forwarding the signals from the site of generation to a transmitter arranged separately can be extensively eliminated.

However, transmitters arranged directly near the body raise other technical problems. Part of the transmitting power may be absorbed by the tissues of the human body. This happens especially at high frequencies that are to be taken into account. This results in unfavorable radiation characteristics. If the human body is located between the transmitter and the reception antenna, this must be overcome by an increased transmitting power as an absorbing obstacle. The attenuation by water molecules is particularly effective especially at frequencies above 1.3 GHz. This is associated with an unintended strong signal attenuation. In addition, an undesired heating of the body fluids may also occur depending on the transmitting power, because the water molecules are excited to perform vibrations owing to their polar character. Such a high radiation exposure is especially problematic in the area of the head, which is sometimes brought into connection with the possibility of the development of damage to the eyes. Concentration of the transmitting power to the area of the head is therefore unfavorable. However, corresponding to the state of the art, especially in mobile radio technology, an especially intense release of transmitting power takes place precisely in this area.

It is possible, in principle, to overcome obstacles that may possibly be in the way by increasing the transmitting power in case of poor quality of transmission or poor reliability of reception.

It is, furthermore, known that the reception geometry can be optimized by the use of a plurality of reception antennas and possibly switching over between these antennas. The use of a plurality of receiving antennas in passenger cars shall be mentioned here as an example.

SUMMARY OF THE INVENTION

The object of the present invention is to develop a method and to propose a process and a device necessary for carrying it out that make it possible to achieve a quasi multidirectional radiation with a low transmitting power and high reliability of reception.

The present invention is based on the fact that the transmitting power necessary for transmission from a transmitter to a receiver is essentially affected, besides by the distance between the transmitter and the receiver, by whether or not obstacles attenuating the transmission are located in the direct path of transmission. If the user himself is moving, his body may move as an attenuating obstacle into the path of transmission in case of transmitters being carried near the body. There are continual variations in the received power in such cases during reception during the movement of the user. To avoid a partial interruption of reception in such cases, it is possible, in principle, to work exclusively with increased transmitting power.

However, it is assumed according to the present invention that if a plurality of antennas is used, it is possible to arrange at least one such that no obstacle with an especially high attenuating capacity is arranged between it and the receiver. If an antenna meets this requirement, at least that antenna is used as a transmitting antenna. This makes possible the reliable transmission of signals generated near the body with a low transmitting power. If the radiation properties change, a changeover from one antenna to another can also be carried out during the transmission. The process according to the present invention comprises the radio transmission of signals generated near the body via an array of at least two antennas arranged in positions near the body, in which process at least one antenna, which will act as a transmitting antenna, is selected before or during the transmission.

The process is carried out with a device for the radio transmission of signals generated near the body, which said device contains at least one electronic assembly unit, which generates the signals to be transmitted, at least two antennas, which are arranged in different positions near the body and are fastened to at least one support means, and means for selecting the antenna or the antennas via which the transmission of the signals is to take place. Parts of the clothing, items of equipment or various fastening means may be used as support means.

The transmitting antenna may be selected in different ways. It is achieved as a result that at least one antenna can communicate with a receiving station over as direct a path as possible, without strongly attenuating obstacles having to be overcome. By performing the selection of the particular optimal antenna in time, it is thus possible to always work with minimum transmitting power without the reception threatening to be interrupted.

The antenna can be selected by simple prognosis and manual selection. It may be useful for the selection of the antenna to be performed as a function of at least one technical parameter characterizing the radio transmission. Such a technical parameter is the voltage standing wave ratio. The voltage standing wave ratio characterizes the radiated transmitting power in relation to the transmitting power fed in. If only a small portion of the power fed in is actually radiated, the antenna is operating ineffectively. To guarantee reliable radio transmission, the power fed in would have to be markedly increased. By contrast, there is a changeover in the process according to the present invention to another antenna, which is characterized by a better voltage standing wave ratio.

As an alternative to the identification of the antenna that happens to have the best voltage standing wave ratio, it is possible to design the process such that only a check is performed to determine whether a selected transmitting antenna has a voltage standing wave ratio that is above a preset threshold value. If a plurality of antennas are above this threshold value, one antenna is selected as the transmitting antenna from this plurality of antennas according to another criterion.

The integration of a shielding layer in the protective clothing is especially advantageous. This effectively prevents the transmitting power released from being radiated into the area of the interior region of the body.

One possibility of concentrating transmitting power in directions facing away from the human body is to use the antennas as shortened $\lambda/4$ radiators with ground base, which protrude from a textile structure at right angles to the ground surface. This has the advantage that the ground surface needed to shorten the antenna can likewise be integrated in the textiles, e.g., by weaving in electrically conductive fibers. This antenna principle nearly completely rules out radiation in the direction of the body. The length of the radiators can be reduced by the use of loading coils and by the use of helix antennas in case of the use of high radio frequencies to the extent that the radiators together with sensors in small sensor modules can be integrated in the textiles.

The radiating power can be increased with an array of radiator groups, so-called phase-coupled antenna arrays with directional characteristic. If the receiver is located in the direction of the maximum radiating power, it is thus possible to work with even more reduced transmitting powers.

Examples of dimensioning the length of such antennas are known from the CB fork. For example, frequencies of 27 MHz are used there, which corresponds to a wavelength of 11 m and a $\lambda/4$ radiator of just 3 m. However, short-bar antennas of a length of 12 cm are used in reality, which can be embodied by the use of loading coils. If this design principle is applied to frequencies commonly used in the mobile telephone service, a scaling factor of about 60 is obtained. A short-bar antenna of a length of 12 cm becomes an antenna with a length of 2 mm. The 1.6 GHz range can be covered with antennas miniaturized in this manner. The 2.4-GHz range, the 5-GHz range and the range of the ISM bands, i.e., 868 MHz and 910 MHz, can be analogously covered.

Other antenna structures, i.e., flat structures such as helical antennas or dipole structures arranged essentially in parallel to the body surface, can also be designed such as to generate a directional effect facing away from the body and integrated in textile layers. Good radiation results can also be achieved if the trunk is used as a shielding and reference surface of antenna radiators arranged on the limbs.

If such antenna structures are integrated in multipart pieces of clothing, it shall be ensured in light of the high frequencies that reliable shielding is achieved in overlapping areas. By arranging antenna structures in parallel to the body surface, it is also possible to embody markedly larger dipole geometries, which means that it is possible to work with lower frequencies. The transmitting power, which is fed by the transmitter end stage into the individual antennas, must be adapted to the conditions, for example, different pieces of clothing with various equipment. A cyclic changeover between the individual antennas can now improve the effective radiation during movement of the person. The direct selection of individual antennas, which is adapted to the particular situation, can also improve the effective radiation and thus minimize transmission errors. For example, an integrated measurement of the reflection factor or even the determination of the voltage standing wave ratio, which is integrated in the transmission process, can help to select the antenna with the best transmission effect or at least with a sufficient transmission effect.

An alternative for this is the possibility of evaluating the received power by cyclically changing over the antennas on the receiver side and to select the antenna that makes optimal reception possible. However, this requires bidirectional data exchange, because the selection must be initiated from the receiver.

Rapid response to changing radiation conditions is possible by the use of the process according to the present invention. These conditions may change, for example, when changes in the positions of different items of equipment in a backpack or metallic compressed air cylinders, which changes are due to movement, temporarily hinder the radiation of the intended transmitted power. This also applies to antennas positioned on the abdominal side when a person is moving flatly over a foundation, which may even be metallic. A reduction of the range may be the consequence in both cases. Concentrating the transmitting power according to the present invention, for example, to antennas arranged near the shoulder, is now meaningful in both cases. If excessively intense attenuation of all antennas on the upper body takes place in especially unfavorable cases, it is possible to briefly change over to an antenna that is integrated, for example, in the helmet or is arranged near the head in another way until the transmission conditions will again become favorable for the use of the other antennas. This may happen or can be brought about deliberately by corresponding movements of the transmitting person or by the removal of attenuating obstacles.

Besides, it is advantageous in alarm situations to provide a possibility of cyclically actuating with full transmitting power all the antennas available at the body, i.e., also a helmet antenna arranged near the head, which is not prioritized in the normal case in order to ensure that an emergency call that may have to be transmitted will be received with certainty.

It may also be advantageous to integrate a multipart antenna structure according to the present invention in an additional piece of clothing, which can be used as an accessory of existing items of equipment. Such an antenna structure, for example, in the form of a jacket, may be designed as an accessory for mobile telephones. The use of such a jacket may be an alternative to the transmitting power sent continuously near the head precisely for people who use their mobile telephones a lot.

The connection of the individual antennas with one another may be designed as a wired connection. A system of electric strip conductors woven into textile structures may be provided for this purpose. Textile structures thus modified can be integrated in clothing which can be manufactured without problems.

If individual pieces of clothing overlap, the individual pieces of clothing may be connected with one another by an inductive coupling by means of inductive transmission means in the area of the overlap.

A frequency range below 1 MHz, for example, 125 kHz or 134 kHz, can be used in case of inductive coupling, which means that the electromagnetic load concerning the energy absorption by the human tissue does not have to be taken into account. If higher frequencies (for example, 13.56 kHz) are used for the coupling, shielding layers, which attenuate the radiation directed toward the body in a suitable manner, may be used on the body side in the overlapping areas of the individual pieces of clothing.

As an alternative to the integration of the antenna structure in the clothing, antennas according to the present invention may be fastened provisionally by pieces of textile that can be fastened, for example, with a Velcro closure. Besides, antennas according to the present invention may be integrated in so-called pads, for example, as adhesive or electrode patches for being placed directly on the skin.

Further explanations of advantageous embodiments of the present invention will be given based on the example of protective clothing for firefighters, without the present invention being limited to this application. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
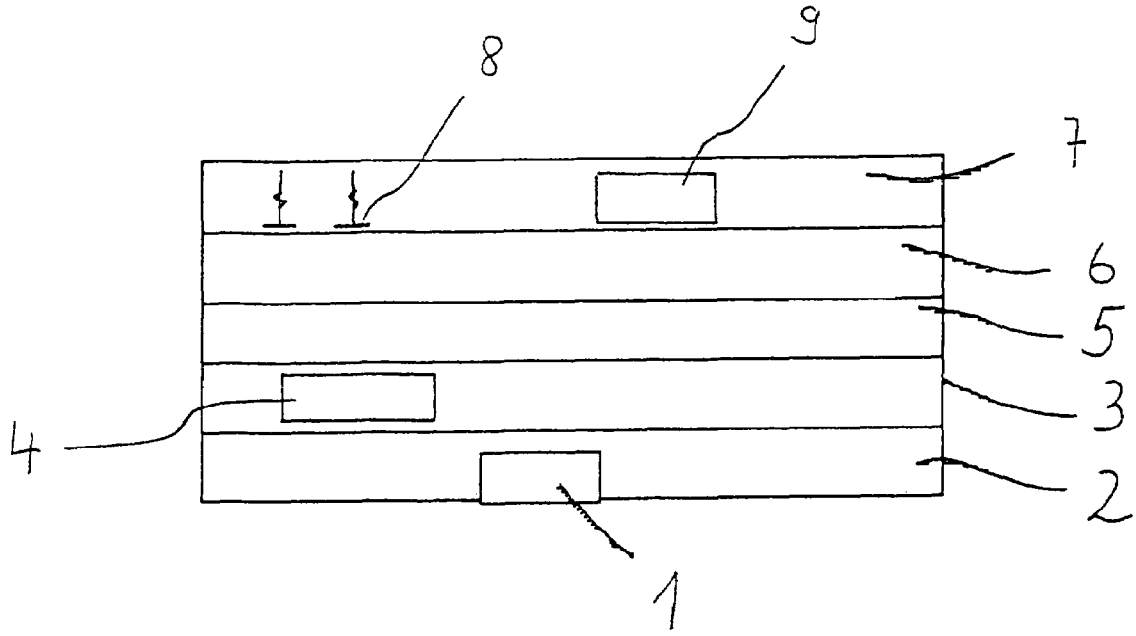
FIG. 1 is a view showing an exemplary layer structure contained in a piece of clothing designed according to the present invention.

Referring to the drawings in particular, an especially advantageous use of the process according to the present invention can be embodied by devices that contain a multilayer structure comprising textile layers. FIG. 1 schematically shows such a layer structure. Various sensors 1 for measuring vital parameters are contained in a lower layer 2. They may be, for example, embedded temperature and pulse sensors. A layer 3, in which operating and evaluating electronic systems 4 and possibly batteries are integrated, is located above it. The battery array may also be designed as a separate layer 5. This is topped by a suitably modified textile layer 6, which acts as a high-frequency shield. The layer 6 acting as a shield may be interwoven or coated with metallic components for this purpose.

In an advantageous embodiment, a plurality of shielding layers may be present and integrated between the individual functional layers. Above this is located a textile layer 7, in which various high-frequency antennas 8 including a power end stage 9 are integrated. The shielding layer 6 prevents the transmitting power radiated from entering the interior of the body, on the one hand, and, on the other hand, it protects the integrated operating and evaluating electronic system 4 from interferences caused by radiated transmitting power during the operation. The operating and evaluating electronic system 4 comprises means to identify by standing wave measurements the antennas that radiate part of the energy fed into them that is above a preset threshold value, or the antenna that radiates the highest possible percentage of the energy fed into it. The operating and evaluating electronic system 4 comprises, furthermore, means for selecting individual antennas as the transmitting antenna.

Figure 2:
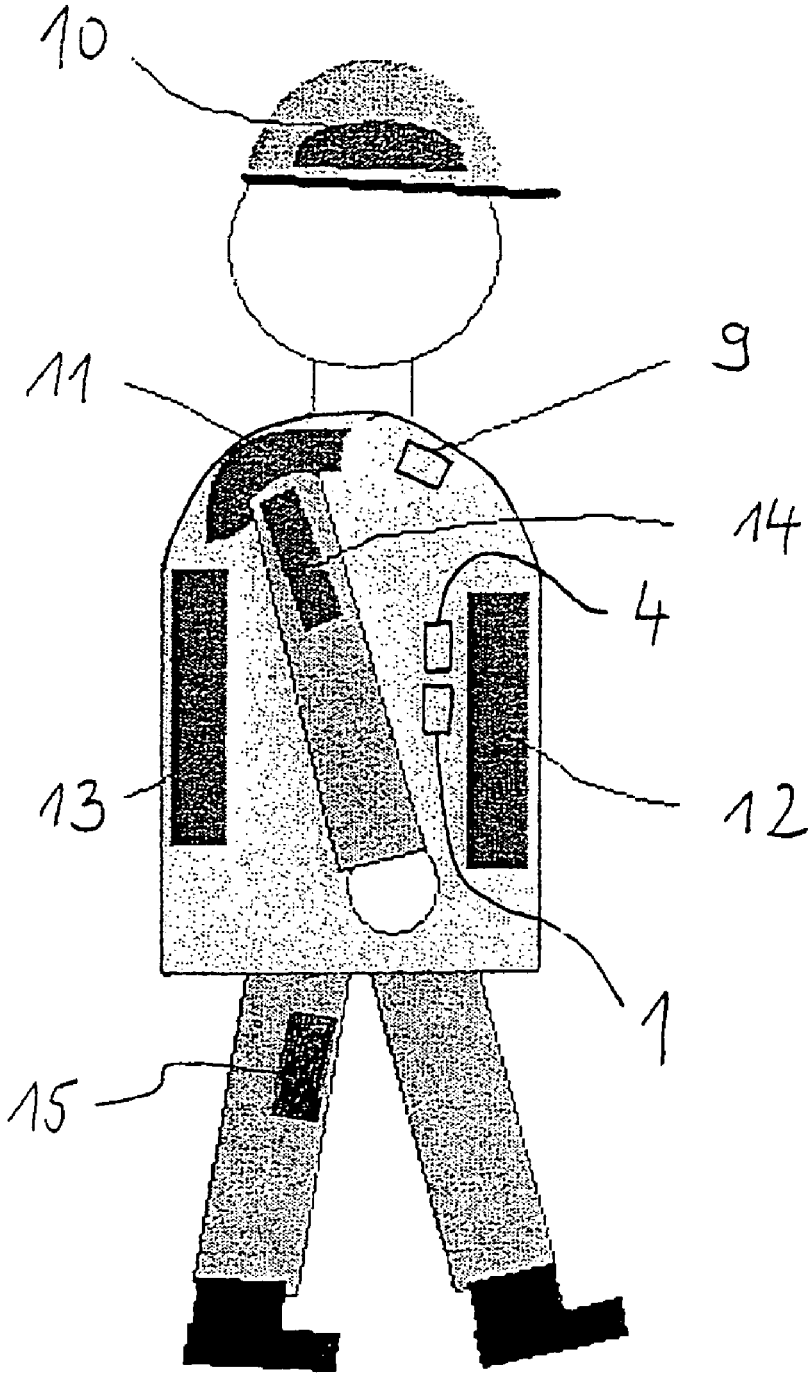
FIG. 2 is a view showing preferred areas for arranging antennas according to the present invention on protective clothing.

FIG. 2 shows preferred areas for arranging the antennas according to the present invention on protective clothing of firefighters.

The multilayer textile structure forms a support means for receiving an antenna array according to the present invention on processing into wearable items of equipment, for example, pieces of clothing. A plurality of antennas with sensors for monitoring vital parameters, batteries, operating electronic system and other components can thus be integrated in a textile layer structure and hence in protective clothing. The layer structure is at least part of the protective clothing of firefighters.

Antennas in the head area 10, in the shoulder area 11, the abdominal area 12 as well as in the area of the back 13 are comprised. Furthermore, antennas may be integrated on the arms 14 and legs 15. All antennas may be connected, individually or in various combinations, with the power end stage 9, which is in turn in connection with the outputs of the sensors for monitoring vital parameters or the operating and evaluating electronic system 4.

The radiation of individual antennas is occasionally attenuated very greatly during movements typical of mission personnel. For example, antennas in the abdominal area can radiate a very low transmitting power only during crawling on the stomach. It is possible to change over to an antenna in the shoulder or back area in the process according to the present invention without problems in this case.

It is especially advantageous if different variable items of equipment are also included as antenna carriers. These may be, for example, safety helmets, gloves, compressed air cylinders, backpacks, etc. If the inclusion of individual items of equipment leads to individual antennas being covered, it is especially advantageous if these items of equipment themselves do in turn comprise an antenna and can act more or less as a replacement for the antenna being covered.

It is advantageous in this connection if inductive transmission means, which make it possible to forward the signals originally intended to be transmitted by the antenna being covered to the antenna of the applied item of equipment, are arranged at the site of the integrated antennas. This forwarding may take place according to the transformatory principle.

Figure 3:
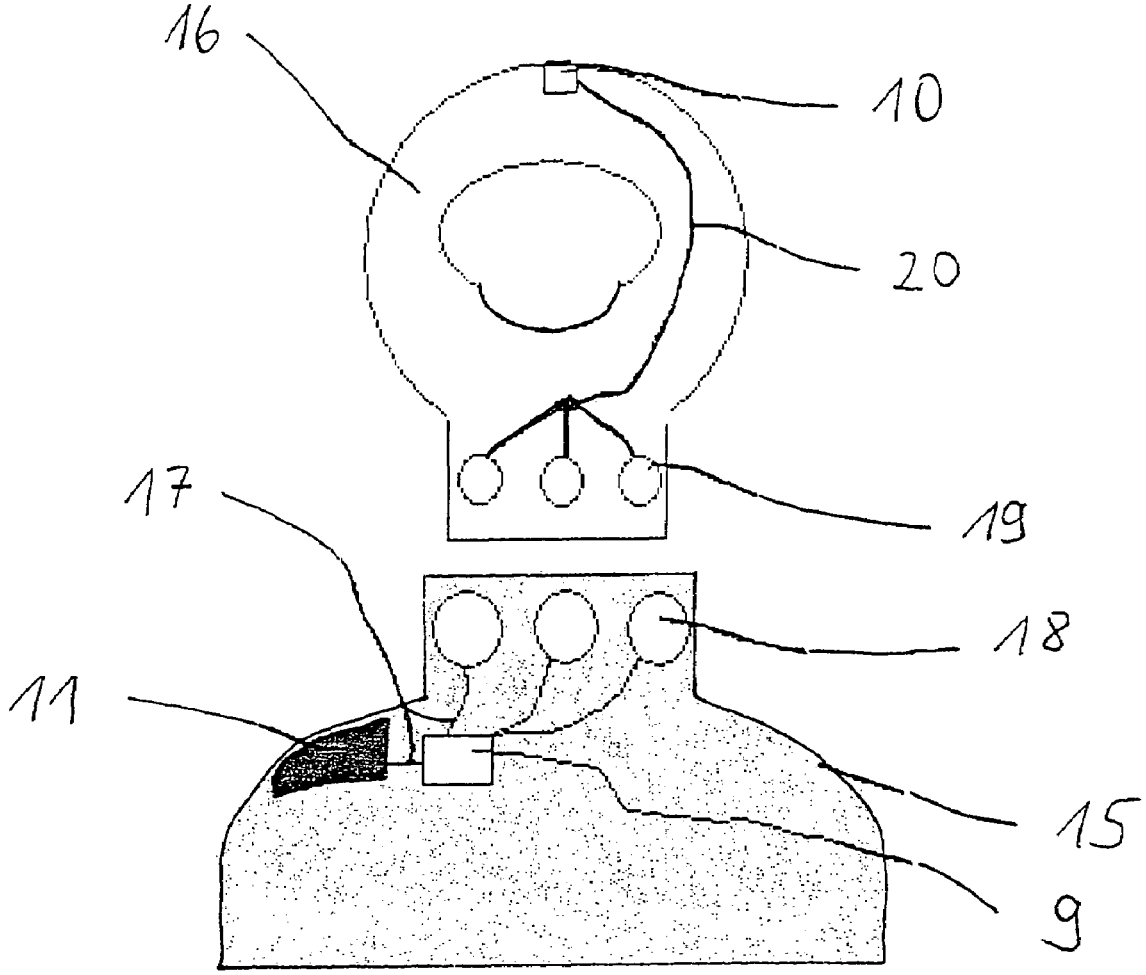
FIG. 3 is a detail of a protective equipment for firefighters, which is equipped according to the present invention.

FIG. 3 shows a detail of a protective equipment for firefighters, which is equipped according to the present invention. A power end stage 9 is integrated with an antenna 11 located near the shoulder in a jacket 15. Another antenna 10 is integrated in a fire safety mask 16. The power end stage 9 can be connected via connection lines 17 with the antenna 11 located near the shoulder and/or with inductive transmission means 18 in the collar area. If the fire safety mask 16 is put on properly, there is an overlap in the collar area between the fire safety mask 16 and the jacket 15. The inductive transmission means 18 in the collar area correspond in this case to inductive transmission means 19 in the lower area of the fire safety mask 16, which are connected with the antenna 10 via a connection line 20 integrated in the mask. By using the inductive transmission means 18, 19, the power end stage 9 in the jacket 15 can thus be connected with the antenna 10 located near the head. Antennas that are located on other items of equipment can be included in this manner in antenna configurations according to the present invention and used to transmit signals generated near the body according to the selection process being claimed. Other connection means may also be used, in principle, to forward the signals to be sent beyond the limits of individual support means.

While specific embodiments of the invention have been shown and described in detail to illustrate the application of the principles of the invention, it will be understood that the invention may be embodied otherwise without departing from such principles.

What is claimed is:

1. A process for the radio transmission of signals generated near the body of a user, the process comprising:

providing an array of at least two antennas arranged fastened to a support means in different positions on the body of the user;

providing an electronic assembly unit, which generates the signals to be transmitted; and selecting at least one antenna, which will act as a transmitting antenna, before or during the transmission wherein the antenna that radiates the highest percentage of the energy fed into thereto is identified by standing wave measurements and this antenna is selected as the transmitting antenna;

detecting a state of alarm by monitoring at least one set parameter, operating all available antennas with maximum transmitting power during said alarm.

2. A process in accordance with claim 1, wherein individual antennas or antenna combinations are used one after another as transmitting antennas, and the antennas or antenna combinations in the case of which an output signal intensity that is above a threshold value is obtained at a receiver are identified in order to select a transmitting configuration from among these antennas or antenna combinations.

3. A process in accordance with claim 1, wherein the antenna with which the lowest radiation into the area of the head can be expected is selected as the transmitting antenna.

4. A process in accordance claim 1, wherein the selection of the at least one antenna that acts as the transmitting antenna is repeated cyclically.

5. A process in accordance claim 1, wherein a transmitting power is reduced to said at least one antenna after the selection of said at least one antenna that will act as the transmitting antenna.

6. A process in accordance with claim 5, wherein the transmitting power is reduced to a preset signal intensity.

* * * * *